US006209369B1

(12) United States Patent
Freck

(10) Patent No.: US 6,209,369 B1
(45) Date of Patent: Apr. 3, 2001

(54) KEY ACTUATED EXTERIOR CAM LOCK

(75) Inventor: Lawrence L. Freck, Crystal Lake, IL (US)

(73) Assignee: Royal Lock Corporation, Wauconda, IL (US)

( * ) Notice: Subject to any disclaimer, the term of this patent is extended or adjusted under 35 U.S.C. 154(b) by 0 days.

(21) Appl. No.: 09/085,588

(22) Filed: May 27, 1998

(51) Int. Cl.[7] ..... E05B 17/18

(52) U.S. Cl. ..... 70/375; 70/379 R; 70/427; 70/455; 70/492; 70/DIG. 43; 70/DIG. 62

(58) Field of Search ..... 70/375, DIG. 62, 70/423, 427, 455, 492, 370, 373, 381, 449, 452, 372, DIG. 43, 379 R, 379 A

(56) References Cited

U.S. PATENT DOCUMENTS

| | | | | |
|---|---|---|---|---|
| D. 352,887 | | 11/1994 | Schlack | D8/384 |
| 1,968,555 | * | 7/1934 | Horne | 70/367 |
| 2,580,882 | * | 1/1952 | Blohm | 70/DIG. 62 X |
| 3,303,678 | * | 2/1967 | Bernard et al. | 70/375 |
| 3,336,774 | * | 8/1967 | Gray et al. | 70/375 |
| 3,367,155 | * | 2/1968 | Kobrehel | 70/375 |
| 3,454,320 | | 7/1969 | Olree | 312/217 |
| 3,477,775 | | 11/1969 | Trent | 312/209 |
| 3,660,999 | * | 5/1972 | Janzeu | 70/276 |
| 3,705,508 | * | 12/1972 | Fritsch et al. | 70/375 X |
| 3,741,619 | | 6/1973 | Dyer et al. | 312/215 |
| 3,774,985 | | 11/1973 | Chovanec et al. | 312/217 |
| 3,863,476 | * | 2/1975 | Patriquin | 70/375 X |
| 3,952,565 | * | 4/1976 | Falk | 70/52 X |
| 4,006,616 | * | 2/1977 | Rubner et al. | 70/455 |
| 4,047,407 | * | 9/1977 | Aranzabal | 70/52 |
| 4,099,398 | | 7/1978 | Lipschutz | 70/406 |
| 4,239,309 | | 12/1980 | De Fouw et al. | 312/221 |
| 4,290,279 | * | 9/1981 | Fish et al. | 70/52 X |
| 4,380,161 | * | 4/1983 | Bassi | 70/370 X |
| 4,385,551 | | 5/1983 | Zboralski | 98/115 |
| 4,425,770 | | 1/1984 | Mentani et al. | 70/252 |
| 4,452,498 | | 6/1984 | Wood, Jr. et al. | 312/216 |
| 4,637,667 | | 1/1987 | Reid et al. | 312/217 |
| 4,715,201 | | 12/1987 | Craig | 70/369 |
| 4,732,434 | | 3/1988 | Hartrum | 312/221 |
| 4,815,304 | * | 3/1989 | Kesselman | 70/34 |
| 4,829,887 | | 5/1989 | Holschbach | 98/115.3 |
| 4,865,248 | | 9/1989 | Barth | 232/24 |
| 5,038,589 | * | 8/1991 | Martin | 70/375 X |
| 5,199,282 | * | 4/1993 | Wang | 70/DIG. 62 X |
| 5,199,285 | | 4/1993 | Lin | 70/220 |

(List continued on next page.)

FOREIGN PATENT DOCUMENTS 2120311 11/1983 (GB) .

OTHER PUBLICATIONS

Jan. 1, 1990 C.T. Johnson Enterprises Sales Literature.

*Primary Examiner*—Lloyd A. Gall
(74) *Attorney, Agent, or Firm*—Michael, Best & Friedrich

(57) ABSTRACT

The present invention provides a key actuated cam lock. The cam lock has a corrosion resistant metal cap. A weather resistant plug cap is rotatably mounted in the corrosion resistant metal cap. The weather resistant plug cap has an opening permitting the entry of the key. A plug body is located adjacent to the plug cap. The plug body has a key entering end and a cam actuating end, and a plurality of spring biased disc tumblers engaging the key when the key is inserted into the plug body. The cam lock also has a lock housing so that the plug body is rotatably positioned within the lock housing. The lock housing has at least one limit stop disposed thereon. The plug body has an internal O-ring providing a weather resistant seal located near the cam actuating end of the plug housing. The O-ring is disposed between the cam actuating end of the plug body and the lock housing. The cam actuating end of the plug body is connected to a corrosion resistant metal stop plate engaging the limit stop upon rotation of the plug body. A rotatable cam is connected to the cam actuating end.

13 Claims, 3 Drawing Sheets

U.S. PATENT DOCUMENTS

| | | | | |
|---|---|---|---|---|
| 5,249,443 | | 10/1993 | Anderson | 70/370 |
| 5,251,467 | | 10/1993 | Anderson | 70/370 |
| 5,265,455 | * | 11/1993 | Grimmer | 70/492 |
| 5,410,898 | * | 5/1995 | Shieh | 70/427 X |
| 5,491,993 | | 2/1996 | Anderson | 70/367 |
| 5,626,041 | * | 5/1997 | Zaccaria | 70/375 X |
| 5,634,359 | * | 6/1997 | Huebschen | 70/379 R |
| 5,640,864 | * | 6/1997 | Miyamoto | 70/379 R |
| 5,685,184 | * | 11/1997 | Gallagher | 70/379 R X |
| 5,765,417 | * | 6/1998 | Bolton | 70/422 X |
| 5,768,923 | * | 6/1998 | Hill | 70/451 X |
| 5,946,957 | * | 9/1999 | Yamamoto et al. | 70/427 X |

* cited by examiner

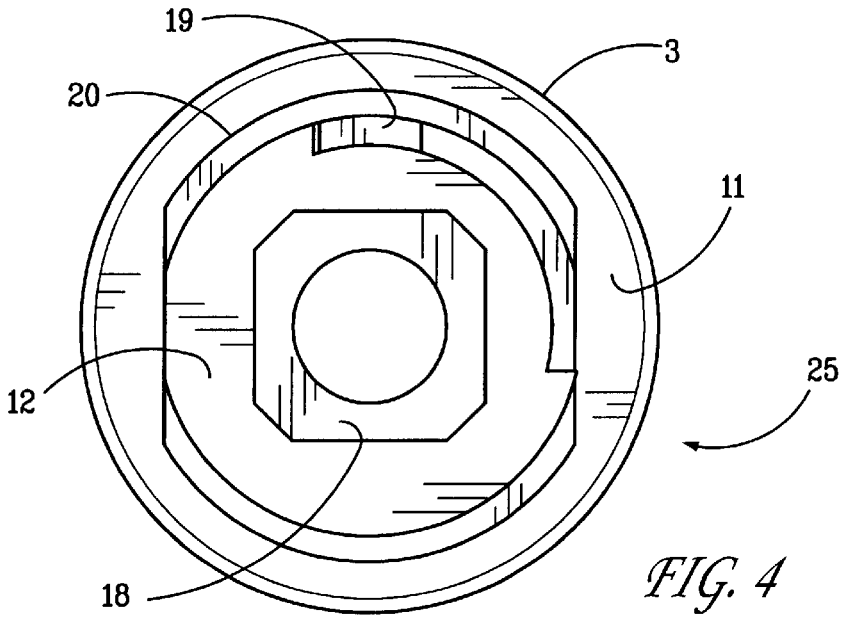
FIG. 4
FIG. 5
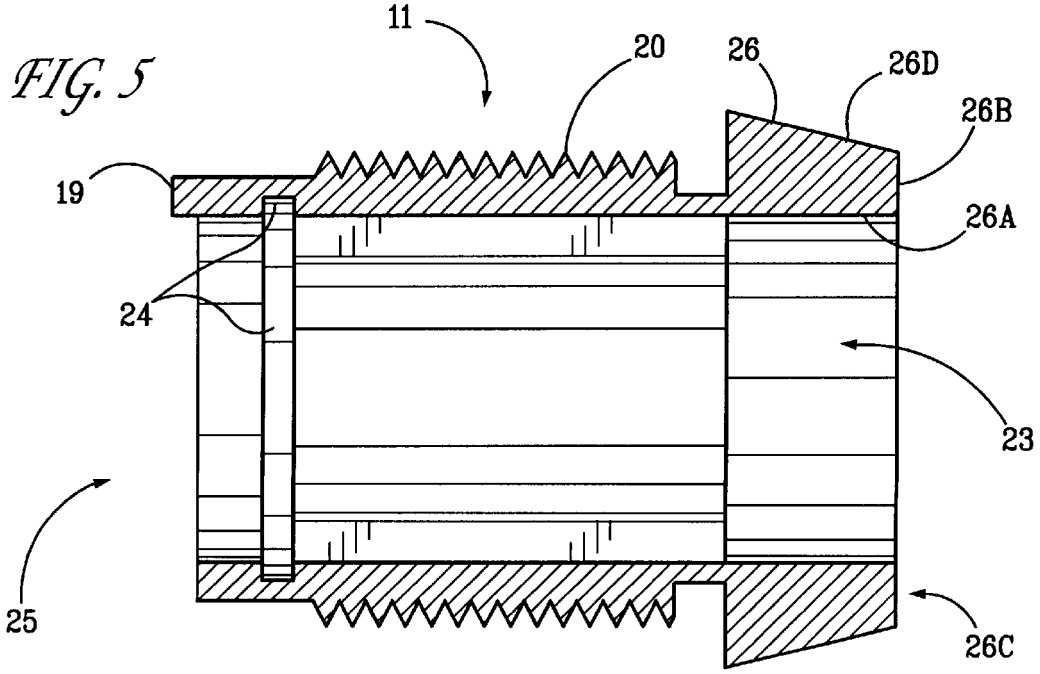

13
14
15
100
12
24
19
20
25
11
23
8
7
8
7
8
21
10
18
7
22
9
27
16
4
3D
3B
3E
3C
3
3F
3A
17
6
5
2
1

KEY ACTUATED EXTERIOR CAM LOCK

BACKGROUND OF THE INVENTION

This invention generally relates to locks; and, more particularly, it relates to key actuated cam locks. There has been a problem related to conventional locking systems in that outside use of these locking systems results in lock malfunction when the locking system is exposed to the elements and other harsh environmental conditions. A conventional key actuated cam lock designed for outside applications can pass less than 240 hours of salt spray testing prior to malfunctioning.

Exemplary conventional locks and keys are disclosed in U.S. Pat. No. 4,006,616 to Rubner et al., U.S. Pat. No. 4,425,770, U.S. Pat. No. 4,099,398 to Lipschutz, U.S. Pat. No. 4,715,201 to Craig, U.S. Pat. No. 5,199,285 to Lin, U.S. Pat. No. 5,265,455 to Grinuner, U.S. Pat. No. 5,491,993 to Anderson, and C.T. Johnson Enterprises sales literature. All of these devices have a number of drawbacks. It is an object of the present invention to solve the problems enumerated above.

SUMMARY OF THE INVENTION

The present invention provides a key actuated cam lock. The cam lock has a corrosion resistant metal cap. A weather resistant plug cap is rotatably mounted in the corrosion resistant metal cap. The weather resistant plug cap has an opening permitting the entry of the key. A plug body is located adjacent to the plug cap. The plug body has a key entering end and a cam actuating end, and a plurality of spring biased disc tumblers engaging the key when the key is inserted into the plug body. The cam lock also has a lock housing so that the plug body is rotatably positioned within the lock housing. The lock housing has at least one limit stop disposed thereon.

The plug body has an internal O-ring providing a weather resistant seal located near the cam actuating end of the plug housing. The O-ring is disposed between the cam actuating end of the plug body and the lock housing. The cam actuating end of the plug body is connected to a corrosion resistant metal stop plate engaging the limit stop upon rotation of the plug body. A rotatable cam is connected to the cam actuating end.

It is an object of the present invention to greatly reduce the replacement cost associated with the use of key actuated cam locks in exterior applications and to increase operability of key actuated cam locks in corrosive or harsh environmental conditions.

The objects and features of the present invention, other than those specifically set forth above, will become apparent in the detailed description of the invention and drawings set forth below.

BRIEF DESCRIPTION OF THE DRAWINGS

FIG. 4 is a rear view of the key actuated cam lock of FIG. 1;

FIG. 5 is a side cross sectional view of the interior lock housing of the key actuated cam lock of FIG. 1; and, FIG. 6 is an exploded perspective view of the key actuated cam lock of the present invention.

DETAILED DESCRIPTION OF THE INVENTION

Figure 6:
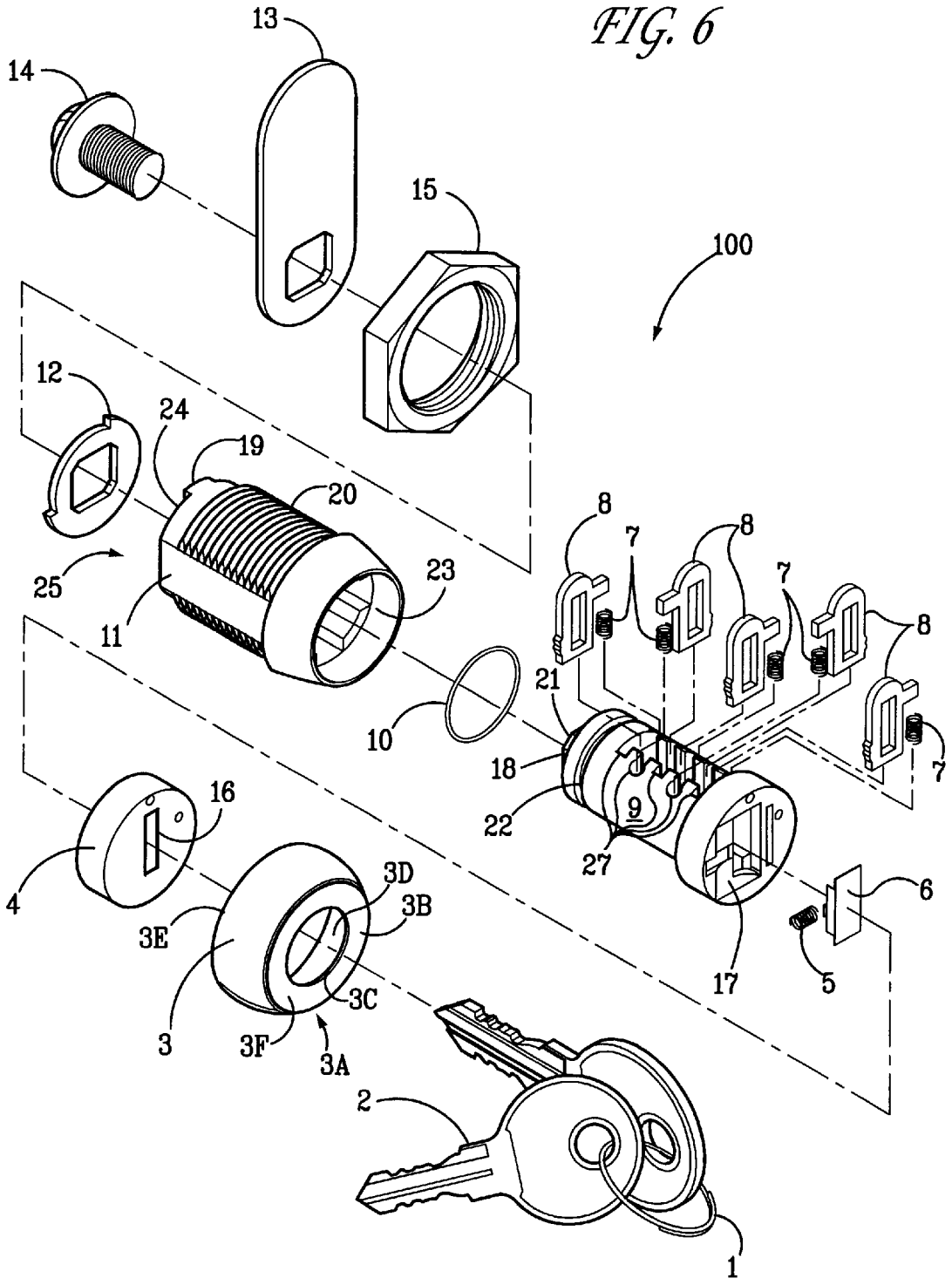

An exploded perspective view of key actuated cam lock of FIGS. 1–4 is provided in FIG. 6. Key actuated cam lock 100 is plated with duplex nickel chrome, and includes corrosion resistant metal cap 3. Metal cap 3 has a flat top surface 3A which is provided by a circular rim 3B having an aperture 3C extending there through. Within metal cap 3 is a tapered inner bore 3D which decreases in diameter from the bottom end 3E of metal cap 3 to a flat interior surface 3F. Corrosion resistant metal cap 3 is selected from the group consisting of a stainless steel cap, a brass cap, a copper alloy cap, and a galvanized metal cap. It is appreciated that other metals that are resistant to corrosion can be used. Corrosion resistant metal cap 3 has weather resistant plug cap 4 rotatably mounted therein.

Plug cap 4 has an opening 16 permitting the entry of key 2 through plug cap 4 and into plug body 9. Plug body 9 is disposed adjacent to and in back of plug cap 4. Plug body 9 has key entering end 17 and cam actuating end 18. Plug body 9 is preferably adapted to receive double bitted reversible key 2. In this variant, plug body 9 has apertures 27 disposed on the top and bottom of body plug 9 as required to accommodate springs 7 and disc tumblers 8. Between key entering end 17 and cam actuating end 18 on plug body 9, a plurality of springs 7 bias disc tumblers 8. Disc tumblers 8 engage key 2 when key 2 is inserted into plug body 9 and either open or lock key actuated cam lock 100 as required. Disc tumblers 8 and springs 7 are protected from the elements by dust shutter 6 which is biased in a closed position by spring 5 until opened by key 2.

Plug body 9 is disposed and rotatably positioned in lock housing 11. Lock housing 11 has a conical head 26 with an aperture 26A extending therethrough. Conical head 26 further has a rim 26B at its top end 26C. When cam lock 100 is assembled, with plug 9 within housing 11 and plug cap 4 seated over key entering end 17 of plug 9, a weather resistant, water tight seal is provided. Lock housing 11 has at least one limit stop 19 at the distal end 25 of lock housing 11. Preferably, there are at least two limit stops 19 diposed on distal end to permit stop plate 12 to rotate through a predetermined range of motion. Corrosion resistant metal stop plate 12 is selected from the group consisting of a stainless steel stop plate, a brass stop plate, a copper alloy stop plate, and a galvanized metal stop plate.

Plug body 9 has an internal O-ring 10 providing a weather resistant seal located near cam actuating end 18 of plug body 9. Preferably, O-ring 10 is disposed between cam actuating end 18 of plug body 9 and lock housing 11. Plug body 9 has annular recess 22 disposed substantially near cam actuating end 18. Annular recess 22 is dimensioned to sealably receive O-ring 10 so that O-ring 10 prevents water from penetrating the lock cylinder.

As shown in FIG. 5, lock housing interior portion 23 has a complementary annular recess 24 disposed thereon for sealably receiving O-ring 10. It is appreciated that rotation of plug body 9 in lock housing 11 is permitted with sealing being provided by O-ring 10. Entry of unwanted debris and the elements is eliminated through the use of O-ring 10, and the combination of the other features of key actuated cam lock 100.

Corrosion resistant metal stop plate 12 is a stainless steel stop plate in one embodiment of the invention. It is appreciated that the components of key actuated cam lock 100 are made of various types of corrosion resistant metals. The corrosion resistant metals are selected from the group consisting of stainless steel and brass, but other alloys are contemplated to be used therein. A particularly advantageous plating which is found to produce unexpected results includes a duplex nickel plating.

Figure 1:
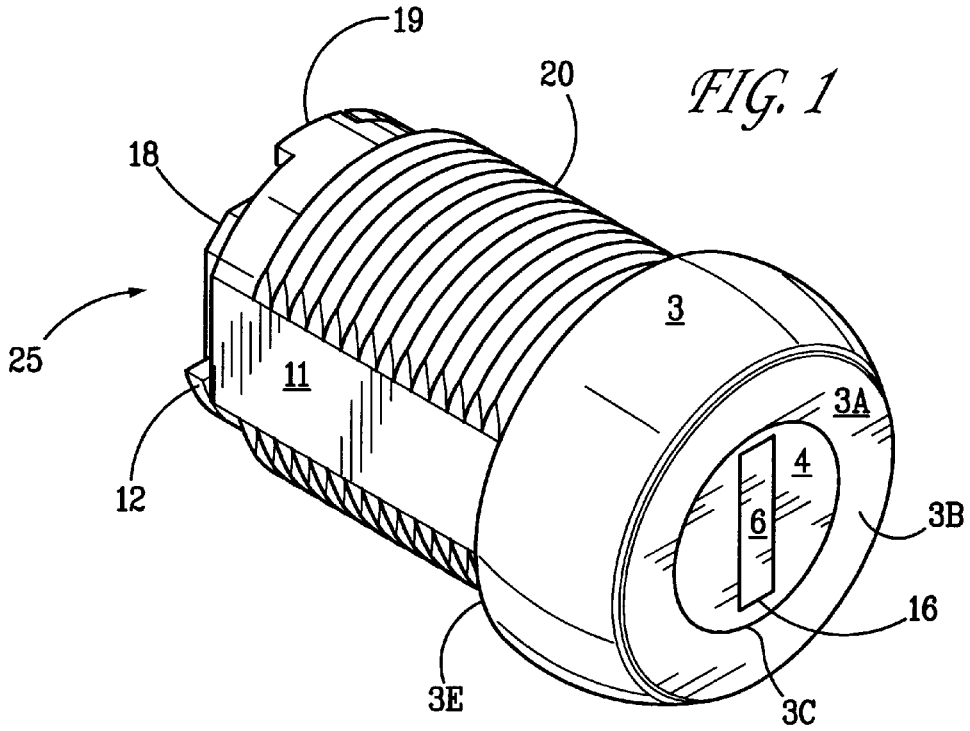
FIG. 1 is a perspective view of a key actuated cam lock.
Figure 2:
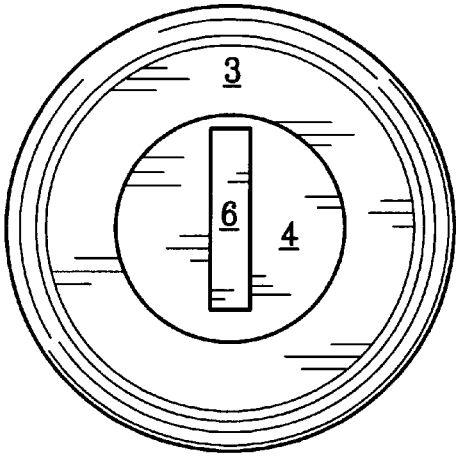
FIG. 2 is a front view of the key actuated cam lock of FIG. 1.
Figure 3:
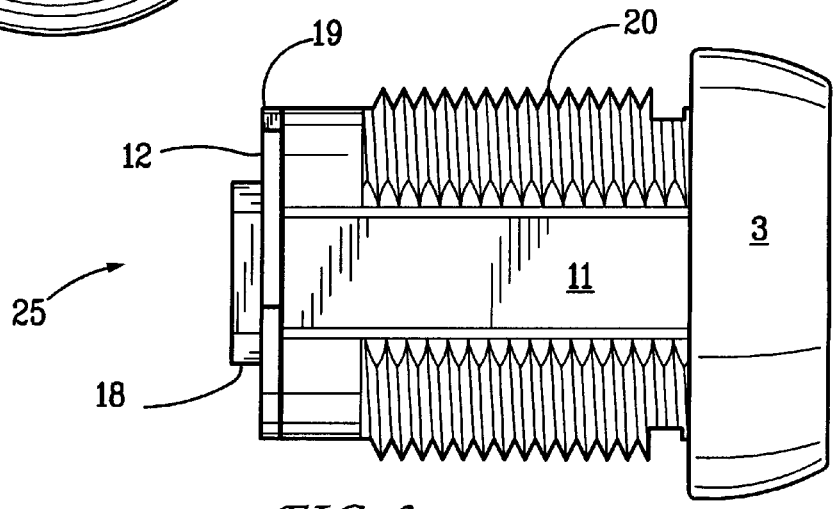
FIG. 3 is a side view of the key actuated cam lock of FIG. 1.

Optionally, threads 20 are located on an exterior portion of housing 11. Threads 20 are sized, positioned, constructed and arranged for threaded insertion into an aperture (not shown) in the object to be locked (not shown). A complementary nickel plated body nut 15 capable of engaging and mating with threads 20 is used to securably mount lock housing 11 to the object to which the key actuated cam lock 100 is being attached. The object fits between body nut 15 and the conically shaped portion 26 of housing 11. Body nut 15 is a hex nut as illustrated in FIG. 1.

Cam actuating end 18 is a square shape or other appropriate geometric shape for actuating and mating with stop plate 12 and cam 13. End 18 has sem screw matable portion 21 which has threads complementary to sem screw 14. In a preferred embodiment of the invention, sem screw 14 is nickel plated. Sem screw 14 secures stainless steel stop plate 12 and cam 13 to plug body 9. Optionally, cam 13 is a duplex nickel plated cam.

In another preferred embodiment, cam lock 100 comprises stainless steel stop plate 12, brass interior components, a nickel plated hex body nut 15, a nickel plated sem screw 14 and, a duplex nickel plated cam 13.

O-ring 10 is made from a flexibly resilient polymeric material. It is optionally made from a material that is self-lubricating. O-ring 10 can be made of a natural or synthetic rubber as required. Most preferably, the O-ring 10 is made of a salt resistant polymeric material.

The invention also provides a method of manufacturing a weather resistant exterior cam lock 100. The method includes plating at least two components of cam lock 100 with a corrosion resistant metal. The components include cap housing 3, weather resistant plug cap 4, an openable dust shutter 6, which is optionally biased closed by spring 5, plug body 9, springs 5, 7, disc tumblers 8, lock housing 11, metal stop plate 12, and rotatable cam 13. The method includes providing a weather resistant seal, which optionally includes O-ring 10, located near cam actuating end 18 of plug body 9; and, assembling a few or all of components 3–24, in combination, to obtain weather resistant exterior cam lock 100.

The Applicant has discovered that the method described herein and the combination of preferred components of key actuated cam lock 100 result in a key actuated cam lock that has superior performance capabilities over conventional key actuated cam locks. These superior performance capabilities include the ability to maintain proper function after over about 480 hours of salt spray testing. Conventional cam locks generally malfunction after about 240 hours of salt spray testing. The present invention has an operable internal and external mechanism for actuating cam lock 100 long after conventional cam locks freeze up in similar test conditions.

These unexpected results are seen in situations where the plating of components of cam lock 100 includes duplex nickel chrome plating. Preferably, the cam lock includes a stainless steel stop plate 12; brass plug body 9; nickel plated hex nut 15; nickel plated sem screw 14; duplex nickel plated cam 13; and, a weather resistant seal that comprises an O-ring 10.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. A key actuated cam lock comprising: a corrosion resistant truncated substantially conical metal cap having an internal bore tapering to a substantially flat front rim, said rim having a central aperture extending therethrough; a weather resistant plug cap having an opening permitting the entry of said key; a plug body disposed adjacent to said plug cap, said plug body having a key entering end and a cam actuating end; said plug body further having a plurality of spring biased disc tumblers engaging said key when said key is inserted into said plug body; a lock housing; said lock housing having a tapered conical head circumferentially disposed about a first end, said tapered conical head being constructed and arranged for mating engagement with said tapered internal bore of said corrosion resistant metal cap; said plug body being rotatably positioned within said lock housing, said lock housing having at least one limit stop disposed thereon; said plug body having an internal O-ring providing a weather resistant seal located near said cam actuating end, said O-ring disposed between said cam actuating end of said plug body and said lock housing; said cam actuating end of said plug body being connected to a corrosion resistant metal stop plate engaging said limit stop upon rotation of said plug body; and, a rotatable cam connected to said cam actuating end.

2. The cam lock of claim 1 in which said corrosion resistant metal cap is selected from the group consisting of a stainless steel cap, a brass cap, a copper alloy cap, and a galvanized metal cap.

3. The cam lock of claim 1 in which said corrosion resistant metal stop plate is selected from the group consisting of a stainless steel stop plate, a brass stop plate, a copper alloy stop plate, and a galvanized metal stop plate.

4. The cam lock of claim 1 in which said cam lock is plated with duplex nickel chrome.

5. The cam lock of claim 1 in which said corrosion resistant metal stop plate is a stainless steel stop plate, and further comprising threads located on an exterior portion of said lock housing; said threads being sized, positioned, constructed and arranged for threaded insertion into an aperture in the object to be locked; a nickel plated body nut capable of engaging said threads and securably mounting said lock housing; said cam actuating end having a sem screw matable portion; a nickel plated sem screw securing said stainless steel stop plate and said cam to said plug body; and, in which said cam is a duplex nickel plated cam.

6. The cam lock of claim 5 in which said nut is a hex nut.

7. The cam lock of claim 1 in which said plug body has an annular recess disposed substantially near said cam actuating end, said annular recess dimensioned to sealably receive said O-ring, whereby said O-ring prevents water from penetrating said lock.

8. An improved key actuated cam lock comprising: a corrosion resistant truncated substantially conical metal cap, having an internal bore tapering to a substantially flat front rim, said rim having a central aperture extending therethrough, a weather resistant plug cap rotatably mounted in said corrosion resistant metal cap, said weather resistant plug cap having an opening permitting the entry of said key;

a brass plug body disposed adjacent to said plug cap, said plug body having a key entering end and a cam actuating end; said plug body further having a plurality of spring biased disc tumblers engaging said key when the key is inserted into said plug body; a lock housing; said lock housing having a tapered conical head circumferentially disposed about a first end, said tapered conical head being constructed and arranged for mating engagement with said tapered internal bore of said corrosion resistant metal cap; said plug body being rotatably positioned within said lock housing; said lock housing having at least one limit stop disposed thereon; said plug body having an internal O-ring providing a weather resistant seal located near said cam actuating end, said O-ring disposed between said cam actuating end of said plug body and said lock housing; said cam actuating end of said plug body being connected to a stainless steel stop plate engaging said limit stop upon rotation of said plug body; and a rotatable duplex nickel plated cam connected to said cam actuating end.

9. The cam lock of claim 8 in which said corrosion resistant metal cap is selected from the group consisting of a stainless steel cap, a brass cap, a copper alloy cap and a galvanized metal cap.

10. A method of creating a weather resistant exterior cam lock, comprising: plating at least two components of said cam lock with a corrosion resistant metal, said components selected from the group consisting of a truncated substantially conical metal cap, having an internal bore tapering to a substantially flat front rim, said rim having a central aperture extending therethrough, a weather resistant plug cap, an openable dust shutter permitting the entry of a key, a plug body, said plug body having a key entering end and a cam actuating end, spring biased disc tumblers, a lock housing, said lock housing having a tapered conical head circumferentially disposed about a first end, said tapered conical head being constructed and arranged for mating engagement with said tapered internal bore of said corrosion resistant metal cap; a metal stop plate, and a rotatable cam; providing a weather resistant seal located near said cam actuating end of said plug body, said weather resistant seal disposed between said cam actuating end of said plug body and said lock housing; and, assembling said components of said weather resistant exterior cam lock.

11. The method of creating a weather resistant exterior cam lock of claim 10 in which said step of plating components of said cam lock with a corrosion resistant metal includes duplex nickel chrome plating.

12. The method of creating a weather resistant exterior cam lock of claim 10 further comprising providing a stainless steel stop plate; a brass plug body; a nickel plated hex nut; a nickel plated sem screw; and, a duplex nickel plated cam.

13. The method of creating a weather resistant exterior cab lock of claim 10 in which said weather resistant seal comprises an O-ring.

* * * * *